United States Patent [19]

Butler

[11] 4,187,957

[45] Feb. 12, 1980

[54] METHOD AND APPARATUS FOR MEASURING LIQUID VOLUME TO BE WITHDRAWN FROM A CONTAINER

[76] Inventor: Calvin J. Butler, 20189 Cheyenne Rd., Bend, Oreg. 97701

[21] Appl. No.: 876,893

[22] Filed: Feb. 13, 1978

[51] Int. Cl.[2] ..... B67D 5/08; B67D 5/44

[52] U.S. Cl. ..... 222/1; 222/43; 222/49

[58] Field of Search ..... 137/577; 116/118 R; 73/298; 222/41, 43, 44, 47, 49, 50, 400.7, 1

[56] References Cited

U.S. PATENT DOCUMENTS

| | | | |
|---|---|---|---|
| Re. 28,970 | 9/1976 | Shapiro | 222/50 |
| 401,413 | 4/1889 | Clark | 222/49 |
| 1,323,649 | 12/1919 | Richards, Jr. | 137/577 |
| 1,642,920 | 9/1927 | Cooper | 222/49 |
| 1,700,659 | 1/1929 | Van Bergen | 222/41 |
| 4,088,245 | 5/1978 | Brown | 222/41 |

*Primary Examiner*—David A. Scherbel
*Attorney, Agent, or Firm*—Kolisch, Hartwell, Dickinson & Stuart

[57] ABSTRACT

Apparatus for use in predetermining volume of liquid to be withdrawn from a container having a top, bottom and side walls includes a conduit insertable through an opening in the top wall which is selectively shiftable within the container for providing a liquid conducting passage. A measuring device is positionable adjacent an external portion of the conduit for displaying liquid volume withdrawable through the conduit when it is linearly shifted to a preselected position.

5 Claims, 2 Drawing Figures

50
50a
B
A
L
L'
10
12
12a
14
16
18
20
22
22a
24
26
28
30
32
32a
34
36
38
40
42
42a
44
46
48

METHOD AND APPARATUS FOR MEASURING LIQUID VOLUME TO BE WITHDRAWN FROM A CONTAINER

BACKGROUND AND SUMMARY OF THE INVENTION

The present invention relates to a method and apparatus for predetermining or measuring a volume of liquid to be withdrawn from a container. More particularly, the present invention is directed to a method and apparatus in which measuring is performed externally of the container prior to the withdrawing of liquid from the container.

Accurate measuring of liquids from containers is particularly important in agricultural spraying where an aircraft is supplied with a mixture of various chemical materials such as pesticides, etc. When it is desired to withdraw pesticide material from containers or drums and supply the material to a mixing tank, various problems arise.

Pesticides are caustic and can cause damage to individuals who inadvertently breath pesticide fumes. Accordingly, it has been the trend in some states to require that mixing of pesticides be conducted in a "closed mixing system". This refers to the fact that liquid pesticide must be withdrawn from pesticide containers and transported to a mixing tank or the like without the escape of pesticide fumes or liquid into the environment.

It has previously been the practice to insert a conduit such as a suction tube through the top wall of a container for withdrawing liquid pesticide. An adaptor for receiving the suction tube may be provided and prevents the escape of fumes from the container. The liquid pesticide may be withdrawn through the suction tube and transferred to a mixing tank. Such methods satisfactorily enable the withdrawing and transporting of pesticides or other caustic liquids, but it has been difficult to determine the exact amount of liquid volume which has been removed unless expensive measuring devices are used.

For instance, it is known to provide flow meters on conduits which will enable the accurate measurement of a liquid volume being withdrawn from a container. However, flow meters are expensive and may require various modifications to be made to a conduit such as a suction tube. Of course, it may be possible to insert a calibrated depth gauge or rod through the opening in the top wall of the container to determine the amount of liquid therewithin. However, such a practice would defeat the purpose of the requirement of a closed mixing system as well as being generally time consuming and inefficient.

Accordingly, it is a general object of the present invention to provide a method and apparatus which includes a suction tube and a measuring device used in conjunction with one another to determine the amount of liquid volume to be withdrawn from a container. The suction tube is positionable vertically through an opening in the top wall of the container and may be extended until it contacts the container's bottom wall. The suction tube is mounted within a sealed adaptor adjacent the opening so that caustic fumes may not escape. The suction tube is vertically shiftable and a datum is noted on an external portion of the suction tube. The calibrated measuring device is fixed relative to the container and, upon upward shifting of the suction tube, the datum is selectively positioned to correspond with a calibration on the measuring device indicating a preselected liquid volume to be withdrawn.

Another object of the present invention is to provide a method and apparatus, as described above, which will enable the use of a separate measuring device manually positionable adjacent the external portion of the suction tube during a measuring operation.

Still another object of the present invention is to provide a measuring device in which the calibrated scale is inverted, i.e. larger numbers descend to smaller numbers vertically upwardly when the measuring device is in an operative position. The measuring device is calibrated for a specific container having a given, maximum depth relative to its volume.

These and additional objects and advantages of the present invention will be more clearly understood from a consideration of the drawings and the detailed description of the preferred embodiment.

DETAILED DESCRIPTION OF THE PREFERRED EMBODIMENT

Figures 1, 2:
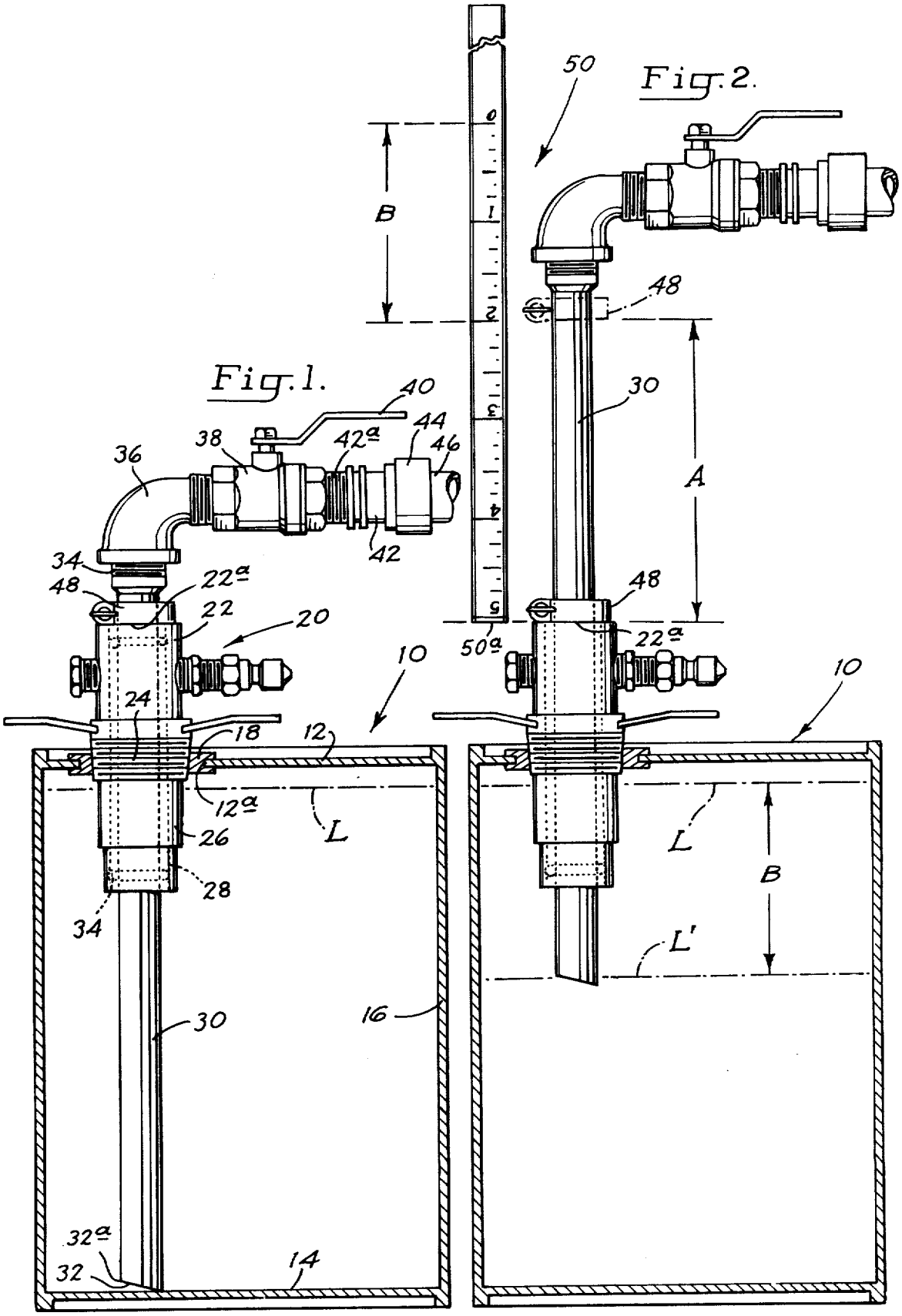
FIG. 1 is a side elevation view of a container, taken in cross-section, showing positioning of a suction tube through an adaptor mounted in an opening in the container's top wall with the tube contacting the bottom wall.
FIG. 2 is a view similar to FIG. 1 illustrating selective positioning of the suction tube and use of a measuring device for predetermining liquid volume to be withdrawn from the container.

As described above, the present invention is directed to a method and apparatus for selectively positioning a suction tube within a container so that a predetermined volume of liquid may be withdrawn. Attention is initially directed to FIG. 1, in which a container is generally indicated at 10, and for purposes of description, is presumed to be a five-gallon container. Top and bottom walls are indicated at 12, 14 respectively, and the container has a cylindrical side wall construction indicated at 16.

Top wall 12 is provided with a conventional opening 12*a* which may be threaded to receive a conventional closure cap (not shown) or, as illustrated, a threaded rim 18 may be mounted within opening 12*a*. Engaged with rim 18 is an adaptor or attachment generally indicated at 20. It is to be noted that attachment 20 includes an upper portion 22, a threaded intermediate portion 24 and a lower portion 26. Attachment 20 may be of the type disclosed in applicant's U.S. Pat. No. 4,039,351 and includes an elongate bore 28 which axially extends through the length of the attachment for guiding a conduit or tube.

A conduit means or suction tube is indicated at 30 for providing a liquid conducting passage and is dimensioned with a periphery and length so that it may be inserted downwardly through bore 28 until it contacts bottom wall 14. An end of suction tube 30 is provided with an inclined or beveled profile as shown at 32 so that liquid may be withdrawn upwardly through the suction tube when it is positioned against the bottom wall. An end 32*a* of the suction tube will extend a small distance above the bottom wall when the suction tube is positioned as shown in FIG. 1. It is to be further noted that attachment 20 is provided with sealing means such as O-ring seals indicated at 34 so that caustic fumes or materials may not escape through the annulus between the bore and the outer diameter of suction tube 30.

Still considering FIG. 1, it can be seen that suction tube 30 extends externally of the container above top surface 22a of attachment 20. The suction tube includes a threaded end 34 to which a suitable elbow 36 is attached. A shut-off valve housing is indicated at 38 and is provided with mechanism 40 for selectively opening and closing a valve (not shown) mounted within the housing. A fitting is shown at 42 and includes a threaded end 42a for connection to suitable receiving threads in valve housing 38. A coupling 44, which may be of the snap-on type, is illustrated as being connected to fitting 42. Extending from coupling 44 is a tube or hose 46 only a portion of which is shown. Hose 46 would normally extend to a reservoir or mixing tank.

It is also to be noted, from consideration of FIG. 1, that a releasable member such as ring-type clamp, indicated at 48, is mounted on an external portion of suction tube 30. Clamp 48 is provided with tightening means so that it may be loosened and selectively positioned along the length of the suction tube and retightened as desired. Clamp 48 serves as an indicating means, particulars of which are to be more fully developed as this description proceeds.

With reference now directed to FIG. 2, it can be seen that a measuring means or device such as a calibrated scale indicated at 50 is used in conjunction with suction tube 30 to provide the apparatus for use in predetermining liquid volume to be withdrawn. Scale 50 is shown with calibrations beginning at zero and extending to the numeral five. The distance between the zero reference and the numeral five is dimensioned to substantially equal the height of liquid L in the five-gallon container when it is full. A small dimension exists between the numeral five and an end 50a of scale 50. This dimension corresponds to the distance that end 32a is above the bottom wall as shown in FIG. 1. With reference also being directed to FIG. 1, operation of suction tube 30 in conjunction with scale 50 for predetermining a liquid volume to be withdrawn from container 10 will now be described.

Initially, it is assumed that container 10 is provided with a cap (not shown) sealed within adaptor 18. The liquid is at level L corresponding to a total liquid volume of five gallons. The cap is removed and attachment 20 is threadedly engaged with adaptor 18 so that lower portion 26 extends into the interior of container 10. Next, suction tube 30 is inserted through bore 28 and opening 12a until the tube is submerged and contacts bottom wall 30 as shown. Mechanism 40 has been previously positioned so that the valve within housing 38 is closed. Coupling 44 may be secured to fitting 42 and clamp 48 is tightened on the external portion of suction tube 30.

It is to be noted that a bottom surface of clamp 48 contacts upper surface 22a of attachment 20 and corresponds to a preselected reference or datum on the external portion tube 30. Scale 50 is then positioned adjacent to suction tube 30 with its scale in ascending order from top to bottom. The end of scale 50 may rest against upper surface 22a but is shown slightly to the side in FIG. 2 for purposes of clarity. Suction tube 30 is then shifted upwardly until the bottom surface of clamp 48, corresponding to the datum, is coextensive with a preselected numeral on scale 50 indicating a liquid volume to be withdrawn. As shown in FIG. 2 in dot-dash, the bottom surface of clamp 48, corresponding to the datum, has been positioned substantially coextensive with numeral two on scale 50. It is to be noted that suction tube 30 has been shifted upwardly a distance represented by A from upper surface 22a of attachment 20. Assuming that it is desired to remove two gallons (represented by the height B), suction tube 30 is fixed relative to container 10 by releasing clamp 48 from its position above and sliding it down the tube and clamping it into position as indicated in solid outline in FIG. 2. Suction tube 30 is then fixed in place and a suitable pump (not shown) may be operated to withdraw liquid out of the container so that it decreases from a level L to a level L'. This will correspond to a withdrawal of approximately two gallons.

Should it be desired to withdraw more liquid, of another preselected volume, it is necessary to now release clamp 48 and shift it upwardly along suction tube 30 (maintaining the suction tube stationary relative to the container) until the bottom of the clamp once again is substantially coextensive with numeral 2. The clamp is then retightened and suction tube 30 is shifted downwardly and lowered to a new position (for instance, adjacent numeral three) whereby the bottom of clamp 48 corresponds to another, larger preselected numeral. At this point, suction tube 30 will be submerged into the liquid to another predetermined depth corresponding to the distance the clamp has shifted along scale 50. At this second predetermined depth, clamp 48 is once again released and shifted so that it contacts upper surface 22a where it is retightened to fix the position of suction tube 30. Liquid may then be withdrawn through the suction tube corresponding to the preselected volume. Similarly, additional volumes of liquid may be withdrawn by selectively positioning clamp 48, generally as described above, and downwardly shifting suction tube 30.

It has been noted that there is a slight distance between the end of scale 50 and the numeral five. This distance corresponds to the distance between the ends of suction tube 30 at its beveled end and must be provided due to the fact that some residue of liquid will remain in the tank because the beveled end will prevent suction of liquid once the liquid drops below end 32a. This is because once liquid drops below point 32a of end 32, the vacuum created by pumping will be destroyed.

There are numerous advantages to the method and apparatus of the present invention for predetermining liquid volume to be withdrawn from a container. First of all, the method is extremely simple and permits the use of a measuring device used externally of the container. Specifically, it is not necessary to calibrate the suction tube itself and thus the tube may be used in containers such as drums or barrels having different diameters. All that is required is that scale 50 corresponds to a certain size drum or barrel and be calibrated in increments over a length substantially equal to the height of liquid in the container when it is full, such as gallons or portions thereof, desired to be withdrawn from a container.

Another advantage in the present invention resides in the use of a releasable member, such as the clamp described above, which permits selection of a datum on the suction tube in a quick and efficient manner. In addition, the clamp may be released and shifted so that it will support the suction tube at a preselected height fixed relative to the container so that a preselected volume may be withdrawn therefrom.

Still another advantage of the present invention resides in the fact that the method and apparatus, as described above, permit accurate measurements to be made while retaining a closed mixing system. This is accomplished by positioning the measuring device at a fixed position, relative to the container, and moving only the suction tube through a sealed adaptor or attachment which extends through an opening in the top wall of the container.

Another advantage of the present invention resides in the fact that after a preselected volume of liquid has been removed from a container, another preselected volume may be accurately withdrawn by precise positioning of the suction tube generally as described above.

While the invention has been particularly shown and described with reference to the foregoing preferred embodiment, it will be understood by those skilled in the art that other changes in form and detail may be made within without departing from the spirit and scope of the invention as defined in the appended claims.

It is claimed and desired to secure by Letters Patent:

1. A method for selectively positioning a conduit means within a container having top, bottom and side walls so that a predetermined volume of liquid may be withdrawn, comprising:

inserting a portion of the conduit means through an opening in the top wall until a lower end of the conduit means is submerged and contacts the bottom wall;

selecting a datum on an external portion of the conduit means corresponding to an initial position relative to the container by securing a releasable member to the conduit means at a position corresponding to the datum;

externally positioning a measuring means having a graduated scale calibrated over a length which is substantially equal to the depth of liquid when the container is full adjacent the external portion of the conduit means;

shifting the conduit means upwardly until the datum is positioned a predetermined distance above its initial position; and releasing the releasable member and attaching it to the conduit means at another, lower location thereon for preventing the conduit means from being inserted further into the container.

2. The method of claim 1 including the additional step of withdrawing liquid from the container until the liquid is depleted to a level adjacent the lower end of the conduit.

3. The method of claim 2 including the additional step of lowering the conduit another predetermined distance into the liquid after said withdrawing step for subsequently withdrawing a second, predetermined volume.

4. Apparatus for use in predetermining volume of liquid to be withdrawn from a container having top, bottom and side walls comprising:

conduit means insertable through an opening in the top wall selectively shiftable within the container for providing a liquid conducting passage;

external measuring means including a graduated scale which is calibrated over a length substantially equal to the depth of liquid when the container is full positionable adjacent an external portion of said conduit means for displaying liquid volume withdrawable through said conduit means when it is linearly shifted to a preselected position; and, indicating means releasably secured to said conduit means, said indicating means being secured to said conduit means and shiftable therewith for indicating on said measuring means a length corresponding to the amount of the shifting, said indicating means also being repositionable on said conduit means for fixing said conduit means relative to the container.

5. The apparatus of claim 4 wherein said measuring means is positionable substantially parallel to said conduit means, its graduated scale displaying increasing numerical amounts from top to bottom.

* * * * *